US008461562B2

(12) United States Patent
Hashimoto

(10) Patent No.: US 8,461,562 B2
(45) Date of Patent: Jun. 11, 2013

(54) WEB CARRIER, WEB CARRYING METHOD, AND WEB CARRIAGE CONTROL PROGRAM

(75) Inventor: Hiromu Hashimoto, Hiratsuka (JP)

(73) Assignees: Toyota Jidosha Kabushiki Kaisha, Toyota-shi, Aichi-ken (JP); Tokai University Educational System, Tokyo (JP)

( * ) Notice: Subject to any disclaimer, the term of this patent is extended or adjusted under 35 U.S.C. 154(b) by 474 days.

(21) Appl. No.: 12/743,253

(22) PCT Filed: Nov. 21, 2007

(86) PCT No.: PCT/JP2007/073007

§ 371 (c)(1), (2), (4) Date: May 17, 2010

(87) PCT Pub. No.: WO2009/066399

PCT Pub. Date: May 28, 2009

(65) Prior Publication Data

US 2010/0243698 A1 Sep. 30, 2010

(51) Int. Cl.
*B65H 23/188* (2006.01)
*B65H 20/02* (2006.01)

(52) U.S. Cl.
USPC ..... 250/559.05; 250/559.07; 250/559.08

(58) Field of Classification Search
USPC ..... 250/559.05, 559.08, 559.07; 242/534.1, 242/418.1; 226/21, 22, 23, 184
See application file for complete search history.

(56) References Cited

U.S. PATENT DOCUMENTS 4,453,659 A * 6/1984 Torpey ..... 226/20
2006/0147232 A1 7/2006 Fuchs et al.

FOREIGN PATENT DOCUMENTS

| | | |
|---|---|---|
| JP | 3-61248 | 3/1991 |
| JP | 3-234338 | 10/1991 |
| JP | 3-255952 | 11/1991 |
| JP | 2000-143053 | 5/2000 |
| JP | 2000-238945 | 9/2000 |
| JP | 2000-343596 | 12/2000 |
| JP | 2002-365225 | 12/2002 |
| JP | 2003-212406 | 7/2003 |
| JP | 2006-117409 | 5/2006 |
| JP | 2007-326657 | 12/2007 |

OTHER PUBLICATIONS

H. Hashimoto, "Prediction Model of Paper-Web Wrinkling and Some Numerical Calculation Examples with Experimental Verifications," Microsyst. Technol., vol. 13, pp. 933-941 (2007).

H. Hashimoto, "Prediction Model of Paper-Web Wrinkling and Some Numerical Calculation Examples with Experimental Verifications," Proceedings of the 8th International Conference on Web Handling, 20 pages (Jun. 5-8, 2005).

* cited by examiner

*Primary Examiner* — Tony Ko
(74) *Attorney, Agent, or Firm* — Finnegan, Henderson, Farabow, Garrett & Dunner, LLP

(57) ABSTRACT

Provided is a web carrier which can prevent creasing of a web by detecting a sign of creasing of a web during carriage of the web. The web carrier (1) for carrying a sheetlike web (10) by means of a plurality of rollers (2) detects the linear pattern of a waveform generated on the web (10) from an image picked up by means of a camera (imaging means) (3) using an image analysis means (73) in a controller (7), recognizes a state becoming the sign of creasing with the aid of the image and simultaneously analyzes the entering direction of the linear pattern into a guide roller (2*c*), drives the shaft (20*c*) of the guide roller (angle adjusting roller) (2*c*) in the direction of canceling the waveform (so that the web is not creased), and controls an alignment adjusting means (5) such that the web is not creased.

6 Claims, 9 Drawing Sheets

(a) Non-Wrinkled (b) Waving (c) Wrinkled

WEB CARRIER, WEB CARRYING METHOD, AND WEB CARRIAGE CONTROL PROGRAM

CROSS-REFERENCE TO RELATED APPLICATIONS

This application is a national phase application of International Application No. PCT/JP2007/073007, filed Nov. 21, 2007, the contents of which are incorporated herein by reference.

TECHNICAL FIELD

The present invention relates to a web transport apparatus, a web transporting method and a web transport control program for transporting a sheet web, in which rollers are used for supporting and transporting the web.

BACKGROUND ART

In the industrial field, a technique of transporting continuous flexible material such as paper, plastic film, metal foil (hereinafter called "web"), using rollers for supporting and transporting the web, which is called a web handling, is widely used. These days, the transport technique is applied to materials provided with the additional value such as liquid crystal color filter made by coating the liquid crystal on the plastic film. According to the increasing demand for such high value-added materials, the transport technique requires high speed, high efficiency and high precision.

Conventionally, various techniques of adjusting a web tension to stably transport the web are disclosed (see e.g. JP 2003-212406 A, JP 2000-143053 A).

For example, a dancer roller disposed between web transporting rollers is moved in the perpendicular direction to the transportation direction to adjust the tension applied to the web by using a pressing apparatus, thereby obtaining the stable transportation of the web without wrinkling and slipping.

However, considering the transporting speed becomes high, the conventional tension control may fail to remove damages such as wrinkles generated during transport. These problems are called web defects that are the technical objective in the industrial field to be solved.

It is thought that the wrinkles are caused by a misalignment, or a non-parallel arrangement of the web transporting rollers, which is adjusted by an operator with his experiences.

In the case that the operator uses the experiences to adjust the arrangement of the rollers, when the wrinkles are generated in the high value-added material such as the liquid crystal color filter, the material cannot be used, which causes a serious damage. In the case where the operator detects a sign of generating wrinkles by the experience during transporting the web and adjusts the arrangement of the rollers, the productivity depends on the operator's ability and the high-speed, high-efficiency transporting is not obtained.

The present invention solves the above-mentioned problems and aims to provide unexpected web transport apparatus, web transporting method and web transport control program capable of detecting the sign of wrinkling of the web during the web transport and of preventing the generation of wrinkles.

SUMMARY OF INVENTION

The present invention is to achieve the goal, and the first aspect of the present invention is a web transport apparatus which transports a sheet web by using multiple rollers and includes a driving roller, an angle adjustable roller, imaging means, alignment adjusting means and a controller that has image analyzing means and shaft angle control means.

In the advantageous embodiment, the web transport apparatus picks up an image of the web, which is transported on the angle adjustable roller that is adjustable in a shaft direction and is disposed adjacent upstream of the driving roller, by means of the imaging means. The apparatus detects a linear pattern showing a waveform (waving) generated on the web from the picked up image, and analyzes an entering direction of the linear pattern into the angle adjustable roller. The waveform is a sign of wrinkling.

The apparatus controls the alignment adjusting means such that the entering direction of the linear pattern analyzed by means of the image analyzing means is perpendicular to the shaft direction by means of the shaft angle control means. The apparatus adjusts the shaft angle of the angle adjustable roller by means of the alignment control means.

Thus, the apparatus weakens the waveform as the sign of wrinkling before the wrinkle is generated and prevents the generation of wrinkles.

In the preferable embodiment of the present invention, the image analyzing means detects the linear pattern of the waveform in the image on the basis of a color or brightness of the image, and determines the direction of the linear pattern as the entering direction on the basis of a predetermined coordinate system.

In the above structure, when the image analyzing means analyzes the picked up image, the apparatus detects the linear pattern of the waveform in the image on the basis of a color or brightness of the image. The apparatus analyzes the direction of the linear pattern by means of the image analyzing means to determine the traveling direction of the waveform on the web.

The web transport apparatus of the present invention further includes a dancer roller, tension measuring means, and tension adjusting means, and the controller further includes critical tension calculating means and tension control means.

The apparatus calculates a critical minimum tension as the critical value in which the web slips and a critical maximum tension as the critical value in which the web is wrinkled, on the basis of a driving information as to a predetermined driving condition (transporting velocity etc.) and of physical properties (Young's modulus, Poisson's ratio etc.) of the web by means of the critical tension calculating means.

The apparatus measures the tension applied by the dancer roller that adjusts the tension on the web by means of the tension measuring means, and moves the dancer roller such that the measured tension is within the critical minimum tension and the critical maximum tension by means of the tension control means.

According to the above-described embodiment, the tension on the web is controlled within the range between the critical minimum tension and the critical maximum tension, thereby preventing wrinkling and slipping.

The second aspect of the present invention is a web transporting method for a web transport apparatus provided with multiple rollers transporting a sheet web which includes a critical tension calculation step, a tension control step, an image analysis step and a shaft angle control step.

In the critical tension calculation step, a critical minimum tension on the web in which the web slips and a critical maximum tension on the web in which the web is wrinkled are calculated on the basis of a driving information as to a predetermined driving condition of the web transport apparatus and of a physical property of the web.

In the tension control step, the tension on the web is controlled such that the tension is within the critical minimum tension and the critical maximum tension.

In the image analysis step, a linear pattern of a waveform generated on the web is detected from an image picked up in the web being transported on an angle adjustable roller that is adjustable in a shaft direction and an entering direction of the linear pattern into the shaft of the angle adjustable roller is analyzed.

In the shaft angle control step, shaft of the angle adjustable roller is moved such that the shaft direction is perpendicular to the entering direction of the linear pattern analyzed in the image analysis step.

The third aspect of the present invention is a web transport control program for a web transport apparatus provided with multiple rollers transporting a sheet web, the program ordering a computer to perform functions as critical tension calculating means, tension control means, image analyzing means and shaft angle control means.

In the critical tension calculating means, a critical minimum tension on the web in which the web slips and a critical maximum tension on the web in which the web is wrinkled are calculated on the basis of a driving information as to a predetermined driving condition of the web transport apparatus and of a physical property of the web.

In the tension control means, the tension on the web is controlled such that the tension is within the critical minimum tension and the critical maximum tension.

In the image analyzing means, a linear pattern of a waveform generated on the web is detected from an image picked up in the web being transported on an angle adjustable roller that is adjustable in a shaft direction and an entering direction of the linear pattern into the shaft of the angle adjustable roller is analyzed.

In the shaft angle control means, shaft of the angle adjustable roller is moved such that the shaft direction is perpendicular to the entering direction of the linear pattern analyzed in the image analysis step.

According to the web transport apparatus as the first aspect of the present invention, when transporting the web, the waveform (waving) as the sign of generating the wrinkle caused by the misalignment among the rollers is detected and the shaft angle (skew angle) of the angle adjustable roller, so that the waveform is dampened. Therefore, due to the present invention, the generation of the wrinkles on the web can be prevented.

Moreover, according to the present invention, the image analyzing means detects the waving, which is dampened, so that there is no need to adjust the arrangement of the rollers by the operator. Thus, the productivity of the web is improved.

Furthermore, according to the present invention, the waveform (waving) generated on the web is detected as the linear pattern in the picked up image of the web, so that the entering direction of the waveform into the angle adjustable roller is determined and the shaft of the angle adjustable roller is accurately moved toward the direction of canceling the waveform.

According to the present invention, in the web transport, the waveform (waving) as the sign of generating the wrinkle caused by the misalignment among the rollers is detected and the shaft angle (skew angle) of the angle adjustable roller, so that the waveform is dampened. Furthermore, according to the present invention, the tension on the web is controlled within the range between the critical minimum tension as the critical value in which the web slips and the critical maximum tension as the critical value in which the web is wrinkled, thereby preventing wrinkling and slipping.

THE BEST MODE FOR CARRYING OUT THE INVENTION

The best mode for carrying out the present invention (the embodiment) is described below, referring attached drawings. Here, an outline regarding a wrinkle generation mechanism on the web explicated by the inventor is firstly explained, and the structure and operation of the web transport apparatus that transports the web without generating the wrinkles are explained in order.

[Wrinkle Generation Mechanism During Web Transport]

Figure 1:
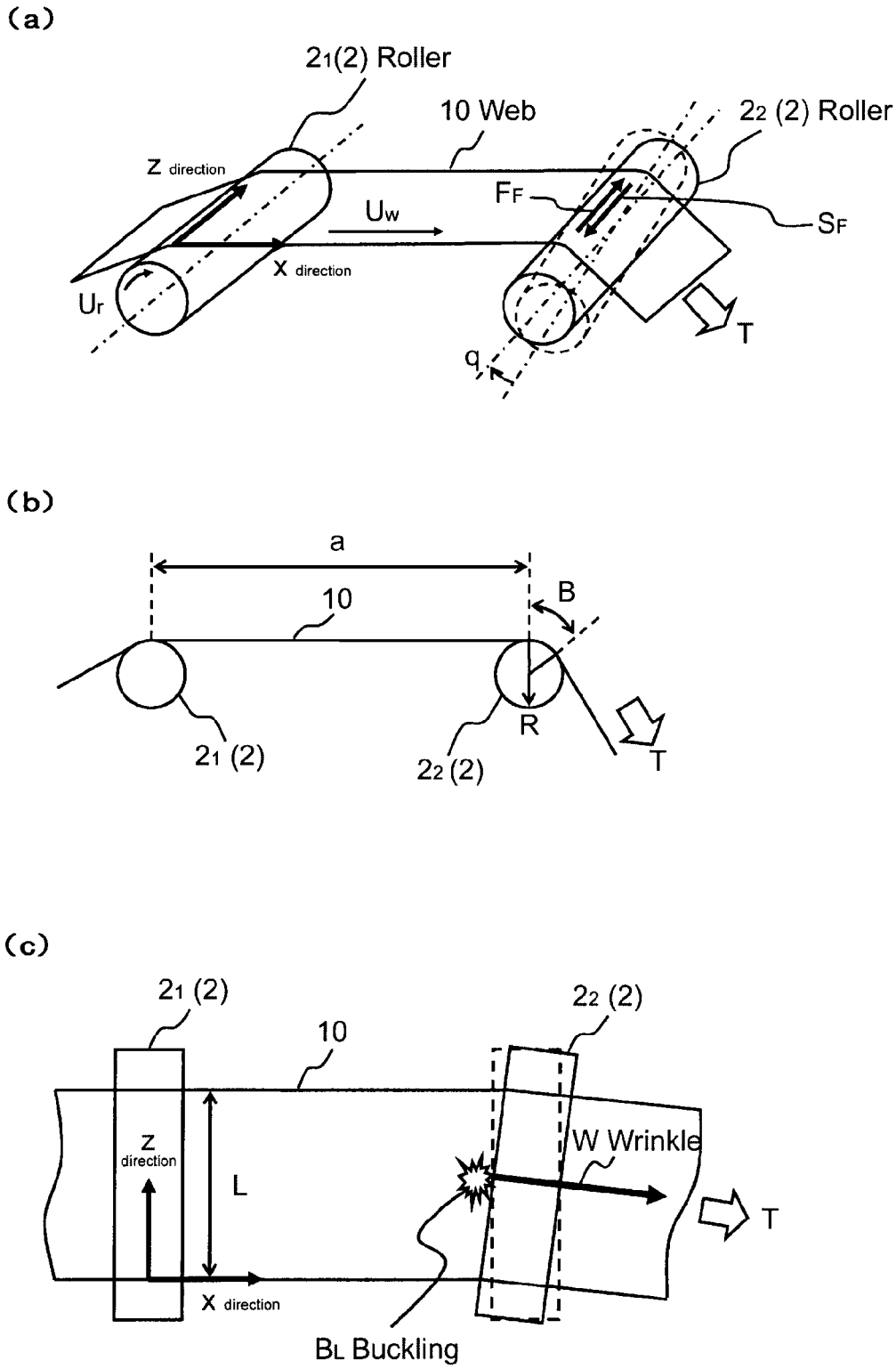
FIG. 1 shows a mechanism for generation of wrinkles in the web.

Referring to FIG. 1, the wrinkle generation mechanism on the web is explained. FIG. 1 shows the mechanism for wrinkling, (a) is a perspective view illustrating the relationship between two rollers and the web, (b) depicts the side view, and (c) depicts the top view. In FIG. 1, the web 10 is transported on two rollers 2 ($\mathbf{2}_1$, $\mathbf{2}_2$). The web 10 (shown as a transparency) is transported from the upstream roller $\mathbf{2}_1$ to the downstream roller $\mathbf{2}_2$.

(Condition for Generating Wrinkle)

The condition that the wrinkle is generated in the web 10 during transportation of the web 10 is explained.

When the rollers $\mathbf{2}_1$, $\mathbf{2}_2$ are disposed parallelly, no wrinkles occur on the web 10. However, if the roller $\mathbf{2}_2$ skews against the roller $\mathbf{2}_1$ and the misalignment within the roller $\mathbf{2}_1$ and roller $\mathbf{2}_2$ occurs, a shear force $S_F$ due to the bending moment is caused in the web 10 on the tangent line of the roller $\mathbf{2}_2$. Assuming the web 10 is a thin beam fixed to the roller $\mathbf{2}_1$, the web 10 is affected by the shear force $S_F$ and bends in the surface. When the shear stress becomes over the critical buckling stress of the web 10 regarded as a plate, a buckling $B_L$ starts to occur at the center of the web 10 approaching the roller $\mathbf{2}_2$, which is the generating point of wrinkle.

The wrinkle is generated when a skew angle θ of the roller $\mathbf{2}_2$ becomes more than a critical misalignment angle $\theta_{cr}$ represented by Formula (1):

$$\theta_{cr} = \frac{6a^2}{E_x L^2}\sqrt{\sigma_{zcr}^2 - \sigma_{zcr}\sigma_x} \tag{1}$$

where a is a roller span [m], L is a web width [m], $E_x$ is a Young's modulus of the web in transportation direction [Pa], $\sigma_x$ is a tensile stress in the transportation direction [Pa], and $\sigma_{zcr}$ is a critical buckling stress [Pa].

The tensile stress $\sigma_x$ is represented by Formula (2):

$$\sigma_x = \frac{T}{t_f} \tag{2}$$

where T is a web tension [N/m], and $t_F$ is a web thickness [m].

The critical buckling stress $\sigma_{zcr}$ is represented by Formula (3):

$$\sigma_{zcr} = \frac{L^2}{i^2 a^2}\left\{\sigma_e\left(1 + \zeta_1 i^4 \frac{a^4}{L^4} + \zeta_2 i^2 \frac{a^2}{L^2}\right) - \sigma_x\right\} \tag{3}$$

where the $\sigma_e$, $\zeta_1$, $\zeta_2$ are given as Formula (4).

The integer i in the formula (3) is determined by the following relation given in Formula (5).

$$\sigma_e = \frac{\pi^2 D_{xx}}{a^2 t_f}, \tag{4}$$

$$D_{xx} = \frac{E_x t_f^3}{12(1 - \nu_x \nu_z)},$$

$$\zeta_1 = \frac{E_z}{E_x},$$

$$\zeta_2 = \frac{4(1 - \nu_x \nu_z)}{1 + \nu_x + (1 + \nu_x)/\zeta_1} + \nu_z + \nu_x \zeta_1$$

$$\sigma_e\left\{1 - i^2(i+1)^2 \zeta_1 \frac{a^4}{L^4}\right\} < \sigma_x < \sigma_e\left\{1 - (i-1)^2 i^2 \zeta_1 \frac{a^4}{L^4}\right\} \tag{5}$$

(Condition for Spreading Wrinkle)

The condition that the wrinkle generated in the web 10 spreads along the transportation direction of the web 10 is explained.

When the web 10 in which the wrinkle is generated passes through the roller $\mathbf{2}_2$, the critical buckling stress of the web 10 wrapped around the roller $\mathbf{2}_2$ is much larger than that of the plate material, so that in the case that the sufficient friction force $F_F$ to sustain the large shear stress is not acted between the web 10 and the roller $\mathbf{2}_2$, the buckling of the web 10 on the roller $\mathbf{2}_2$ does not occur and the wrinkle disappears.

On the other hand, when the sufficient friction force $F_F$ acts between the web and the roller $\mathbf{2}_2$, the web 10 is buckled over the roller $\mathbf{2}_2$ and the wrinkle spreads.

The wrinkle spreads when the tension on the web 10 is greater than a critical maximum tension $T_{wik}$ shown in Formula (6):

$$T_{wik} = \frac{2t_f^2}{\mu L}\sqrt{\frac{E_x E_Z}{3(1 - \nu_x \nu_z)}} \tag{6}$$

where $t_F$ is the web thickness [m], μ is a friction coefficient between the web and the roller, L is the web width [m], $E_x$ is the Young's modulus of the web in transportation direction [Pa], $E_Z$ is a Young's modulus of the web in width direction [Pa], $V_x$ is a Poisson's ratio of the web in transportation direction, and $v_z$ is a Poisson's ratio of the web in width direction.

The friction coefficient μ is given as following Formula (7):

$$\mu = \frac{1}{RB}\int_{-RB/2}^{RB/2} \mu_l dx \tag{7}$$

where R is a roller radius [m], and B is a web wrap angle [rad]. $\mu_L$ is given as following Formula (8):

$$\mu_l = \begin{cases} \mu_c & (h < \sigma) \\ \frac{\mu_c}{2}\left(3 - \frac{h}{\sigma}\right) & (\sigma \le h \le 3\sigma) \\ 0 & (h > 3\sigma) \end{cases} \tag{8}$$

where $\mu_c$ is a border friction coefficient between the web and the roller, h is an air film thickness [m], and σ is a surface roughness between the web and the roller.

The surface roughness σ is a composite value calculated by following Formula (9), using the surface roughness of the roller $\sigma_r$ and that of the web $\sigma_w$.

$$\sigma = (\sigma_r^2 + \sigma_w^2)^{1/2} \tag{9}$$

The air film thickness h is determined by following Formula (10):

$$h = 0.589R\left(\frac{6\eta U}{T}\right)^{2/3} - \frac{kTB}{\eta t_f U}\left(1 + \frac{2x}{RB}\right) \tag{10}$$

When $h < 0$, $h = 0$ where η is an air film viscosity [Pa·s], T is a web tension [N/m], k is a web permeability [$m^2$], x is a coordinated in the web transportation direction [m], and U is a web transportation velocity [m/s]. As to the coordinate x, the coordinate of the start point of winding is set as x=−RB/2, that of the end point of winding is set as x=RB/2(−RB/2≦x≦RB/2). The web transportation velocity U is an added value ($U_r$+$U_w$): where $U_r$ is a roller velocity and $U_w$ is a web velocity.

When the tension T on the web 10 is not more than the critical tension $T_{wik}$ shown in Formula (6), the wrinkle is not generated. While, when the tension T is too small, the friction force between the web 10 and the roller 2 and they are easy to slip, so that the transport of the web 10 is difficult.

Thereby, a critical tension (critical minimum tension) $T_{slip}$ of the tension T preventing the slip is calculated.

Generally, the limit of occurring slip is shown as Formula (11):

$$(e^{\mu B} - 1)TLR = M_b \tag{11}$$

here Mb is a known value as bearing torque, and may be regarded as "zero." From Formula (11), the friction coefficient μ is given as Formula (12).

$$\mu = \frac{1}{B}\ln\left(1 + \frac{M_b}{TLT}\right) \tag{12}$$

The friction coefficient μ is a function of the tension T, and the friction coefficient μ determining the critical tension $T_{slip}$ satisfies the following relation given in Formula (13).

$$\mu(T_{slip}) \cong 0 \tag{13}$$

From Formulas (7) and (8), the critical tension $T_{slip}$ satisfies Formula (14).

$$\mu(T_{slip}) = \int_{-RB/2}^{RB/2} \mu_l(T_{slip}) dx = 0 \tag{14}$$

When the web 10 has gas non-permeability such as film or metal foil, k=0 in Formula (10). So, where the air film thickness h is "3σ", $\mu_L$ is "zero" from Formula (8). In this case, when k=0 in Formula (10), Formula (15) is obtained.

$$h = 0.589R\left(\frac{6\eta U}{T_{slip}}\right)^{2/3} = 3\sigma \tag{15}$$

The critical minimum tension $T_{slip}$ is given as Formula (16).

$$T_{slip} = 0.522\eta U\left(\frac{\sigma}{R}\right)^{-3/2} \tag{16}$$

Note that when the web 10 has gas permeability such as paper or textile, solving Formula (14) by using Newton-Raphson method, the critical tension $T_{slip}$ is obtained.

Figure 2:
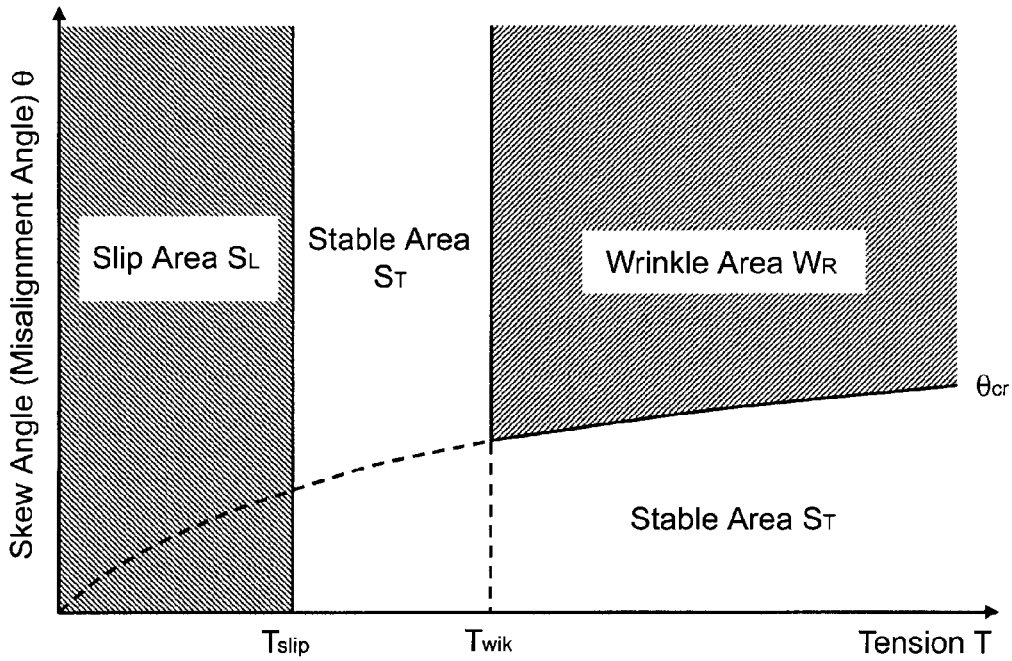
FIG. 2 is a graph showing a condition for preventing the wrinkles and obtaining the stable web transport.

The above-described conditions are graphed. FIG. 2 is a graph showing a condition for preventing the wrinkles and transporting the web with stability, and it is the graph of the skew (misalignment) angle of the roller versus the tension on the web.

As shown in FIG. 2, when the tension T is more than the critical minimum tension $T_{slip}$ calculated by Formula (16) and less than the critical maximum tension $T_{wik}$ calculated by Formula (6), the web 10 is stably transported without slipping and wrinkling.

When the tension T is less than the critical minimum tension $T_{slip}$, the slip occurs, and when the tension T is more than the critical maximum tension $T_{wik}$, the wrinkle is generated. However, the skew angle θ of the roller $\mathbf{2}_2$ is set less than the critical misalignment angle $\theta_{cr}$ calculated by Formula (1), so that the web 10 is stably transported without generating wrinkles.

Thus, in the web transport, in order to stably transport the web without occurring slips and generating wrinkles, the tension T on the web 10 and the skew angle θ of the roller $\mathbf{2}_2$ are maintained in the stable area $S_T$ apart from the slip area $S_L$ and the wrinkle area $W_r$ in the graph shown in FIG. 2.

The structure and operation of the web transport apparatus enabled to maintain the tension T on the web 10 and the skew angle θ of the roller in the stable area $S_T$ is explained below.

[Structure of Web Transport Apparatus]

Figure 3:
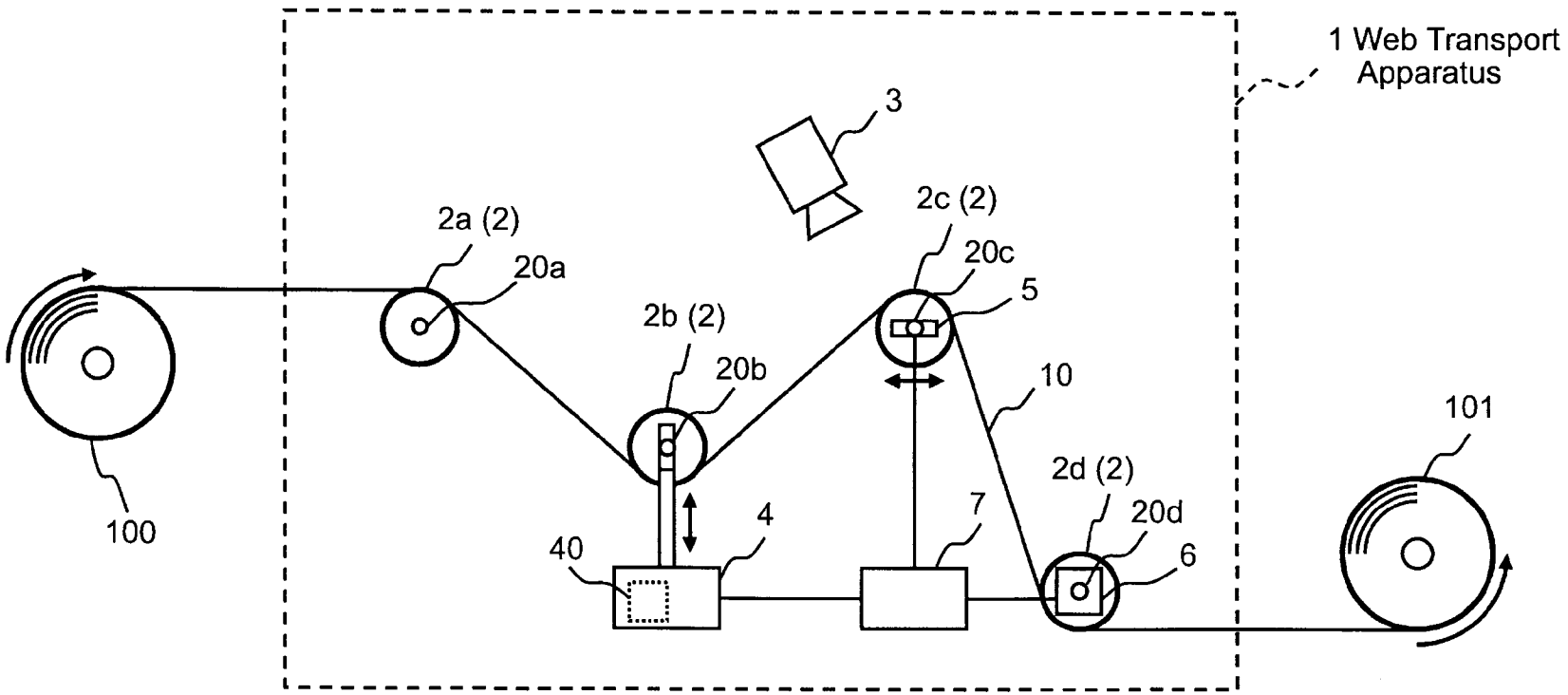
FIG. 3 depicts a side view of the web transport apparatus according to the present invention.
Figure 4:
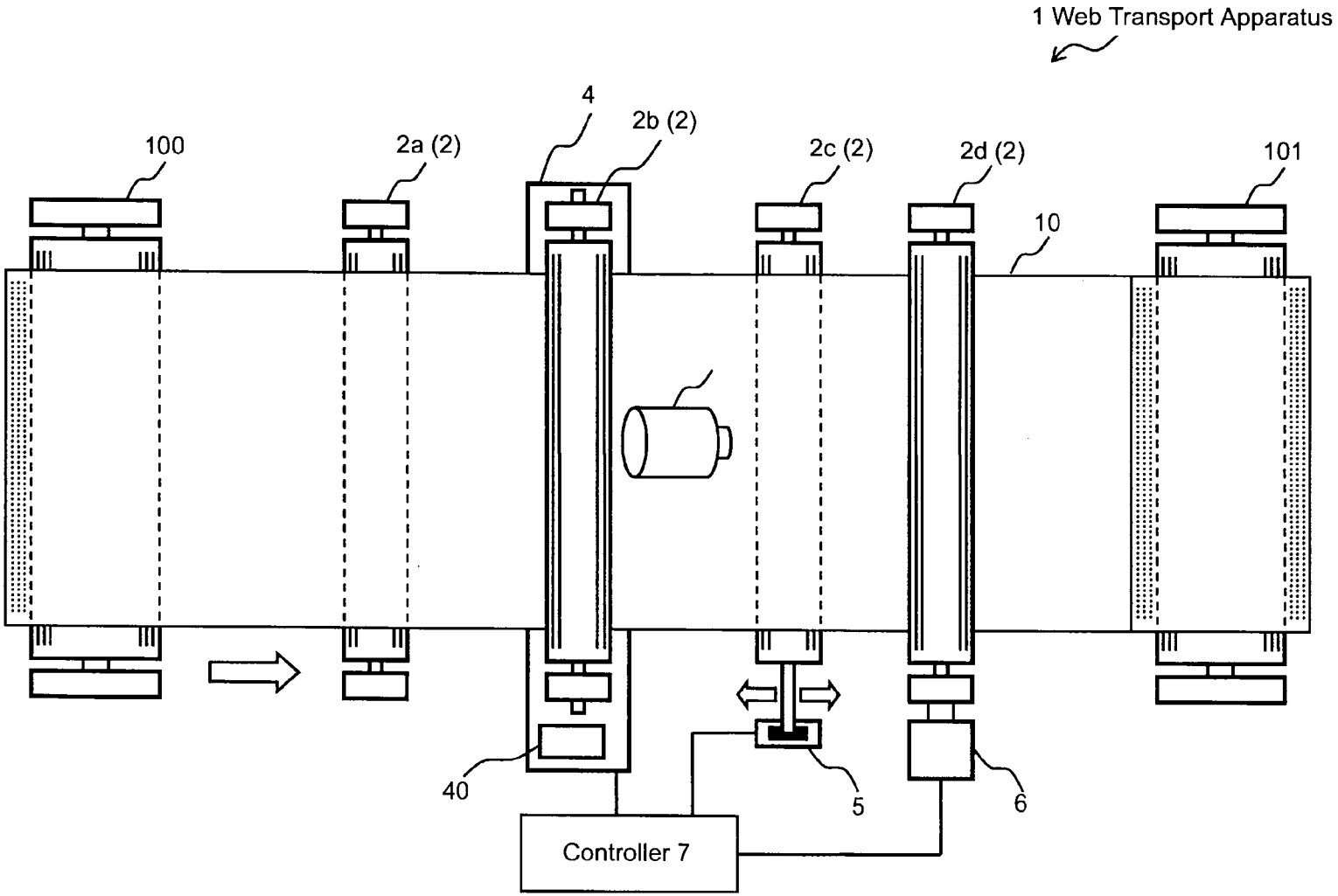
FIG. 4 depicts a top view of the web transport apparatus according to the present invention.

Referring to FIGS. 3, 4, the web transport apparatus in accordance with the present invention is explained. FIG. 3 depicts the side view of the web transport apparatus. FIG. 4 depicts the top view of the web transport apparatus.

As depicted in FIGS. 3, 4, the web transport apparatus 1 transports the web 10 composed of continuous flexible material such as paper, plastic film, metal foil or the like with the rollers 2 without generating wrinkles and occurring slips.

The apparatus 1 transports the web 10 from a delivery part 100 to a winding part 101. The apparatus 1 includes the rollers 2, a camera 3, tension adjusting means 4, alignment adjusting means 5, roller driving means 6, and a controller 7.

The rollers 2 rotate around shafts to transport the web 10 from upstream to downstream. The rollers 2 contains a support roller 2*a*, a dancer roller 2*b*, a guide roller 2*c*, a driving roller 2*d*. The shafts of these rollers 2 are parallel. Unfortunately, the shafts are not always parallel, so that the skew angle of the guide roller 2*c* changes to keep the parallelity.

The support roller 2*a* has a shaft 20*a* pivoted to the main body of the apparatus 1 and is configured as a driven roller for transportation of the web 10. The support roller 2*a* leads the web 10 delivered from the delivery part 100 to the dancer roller 2*b*.

The dancer roller 2*b* has a shaft 20*b* being adjustable in position and applies the tension to the web 10. In the dancer roller 2*b*, the tension adjusting means 4 moves the shaft 20*b* in the perpendicular direction to the install surface such that the tension acts on the web 10.

The guide roller (angle control roller) 2*c* has a shaft 20*c* having one end fixed to the main body of the apparatus 1 and other end (movable end) adjustable in position. In the guide roller 2*c*, the alignment adjusting means 5 adjusts the other end of the shaft in the horizontal direction to the install surface so that the parallelity to the shafts of upstream rollers.

The driving roller 2*d* has a shaft 20*d* rotated by the roller driving means 6 to generate the friction force within the web 10 and transport the web 10. The driving roller 2*d* transports the web 10 delivered from the guide roller 2*c* to the winding part 101.

The camera (imaging means) 3 is disposed in the neighborhood of the guide roller 2*c* and picks up the image of the web 10. The image picked up by the camera 3 is transmitted to the controller 7 as an image signal in the frame unit. The image picked up by the camera 3 is analyzed in the controller 7 to determine whether a waveform as the wrinkle sign occurs in the web 10 or not. The analyzing method is explained later with the structure of the controller 7.

The tension adjusting means 4 adjusts the position of the shaft 20*b* of the roller 2*b* to control the tension on the web 10. The tension adjusting means 4 moves the shaft 20*b* of the roller 2*b*, on the basis of the drive signal (for tension control), in the perpendicular direction to the install surface so that the tension applied to the web 10 is adjusted. The tension adjusting means 4 may be a hydraulic cylinder, an air cylinder or the like.

In the embodiment, the tension adjusting means 4 adjusts the shaft 20*b* of the roller 2*b* in the vertical direction, although the moving direction is not limited and may be the direction in which the tension on the web 10 can be adjusted in accordance with the roller arrangement.

The tension adjusting means 4 contains a tension sensor 40 measuring the tension on the web 10, and transmits the measured tension to the controller 7.

The alignment adjusting means 5 adjusts the skew angle (misalignment angle) of the shaft 20*c* of the guide roller 2*c*. In the embodiment, the alignment adjusting means 5 moves the movable end of the shaft 20*c* of the roller 2*c*, on the basis of the drive signal (for alignment control), in the horizontal direction to the install surface so that the skew angle of the shaft 20*c* is adjusted. The alignment adjusting means 5 may include a micro screw for adjustment of the movable end of the shaft 20*c* or a piezo device deformed in response to electric voltage or magnetism for adjustment of the movable end of the shaft 20*c*.

In the embodiment, the alignment adjusting means 5 adjusts the shaft 20*c* of the roller 2*c* in the horizontal direction, although the moving direction is not limited and may be the direction in which the entering direction of the web 10 into the roller 2*c* can be adjusted.

The roller driving means 6 drives the shaft 20*d* of the driving roller 2*d* to rotate, and is, e.g., a normal motor. In the embodiment, the roller driving means 6 rotates the shaft 20*d* of the roller 2*d* on the basis of the drive signal (for power supply).

The controller 7 is a control unit for the web transport apparatus 1 and configured as a normal computer including a CPU (Central Processing Unit), a RAM (Random Access Memory) and the like.

Figure 5:
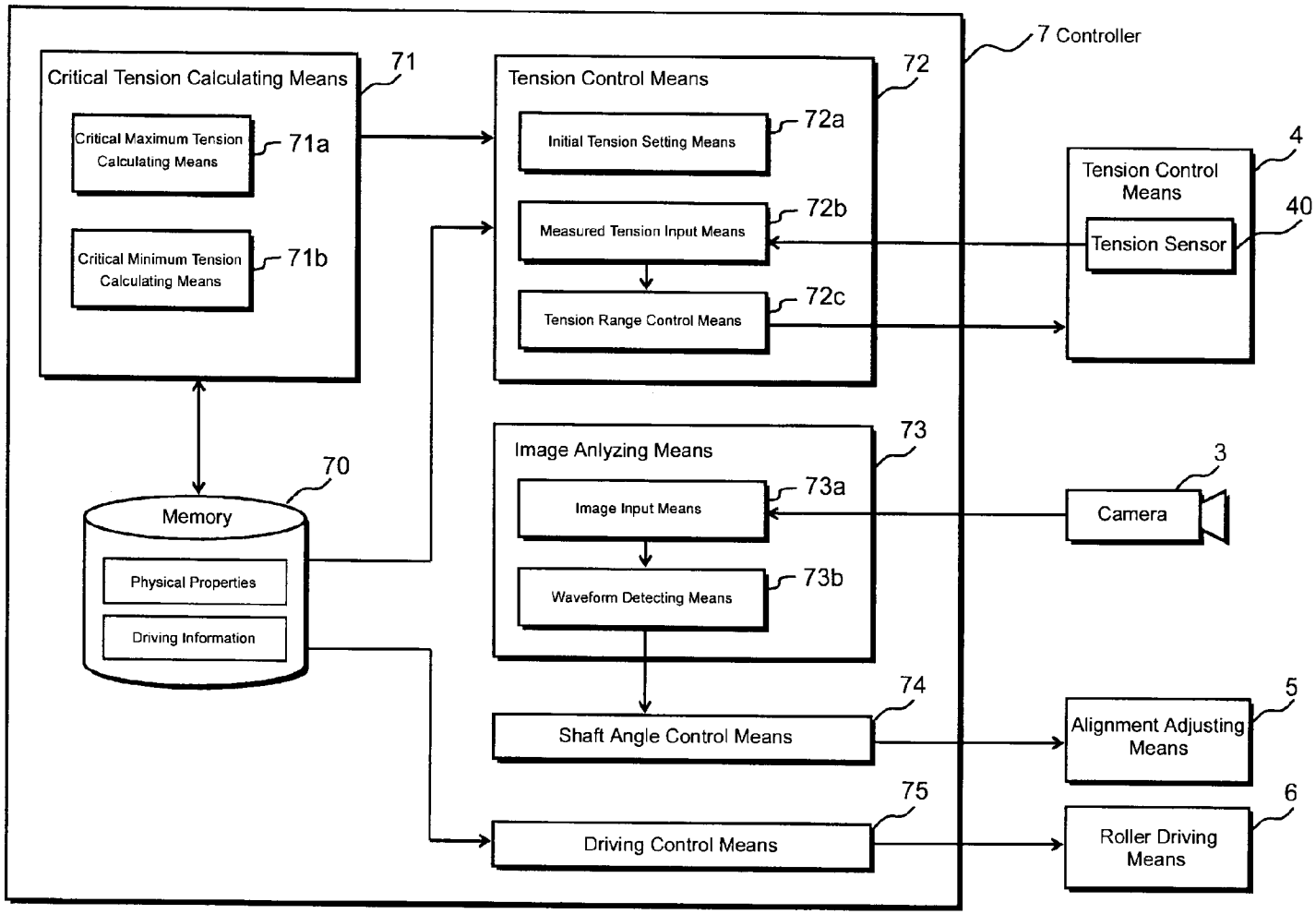
FIG. 5 is a block diagram of a controller installed in the web transport apparatus.

Referring to FIG. 5 (and FIGS. 3, 4), the structure of the controller 7 is explained. FIG. 5 is a block diagram of the controller.

The controller 7 includes a memory 70, critical tension calculating means 71, tension control means 72, image analyzing means 73, shaft angle control means 74 and drive control means 75.

The memory 70 memorizes values of physical properties of the web 10, driving information and the like, and is configured as a normal memory such as semiconductor memory, hard disc and so forth.

The values of physical properties of the web 10 memorized in the memory 70 are the unique values of the web 10 such as Young's modulus, Poisson's ratio, web thickness, web width, and friction coefficient explained in Formulas (1) through (16).

The driving information memorized in the memory 70 contains condition values for driving the apparatus 1 such as roller radius, web wrap angle, and web transportation velocity explained in Formulas (1) through (16).

The values of physical properties and driving information may be memorized in the memory 70 in advance, or inputted via input means such as keyboard (not shown).

Further, the memory 70 memorizes the critical values calculated by the critical tension calculating means 71.

The critical tension calculating means 71 calculates a critical condition for preventing wrinkles and slips of the web 10 during the transportation of the web 10. The means 71 includes critical maximum tension calculating means 71*a* and critical minimum tension calculating means 71*b*.

The critical maximum tension calculating means 71*a* calculates the maximum tension on the web 10, in which the wrinkle is generated in the web 10. The means 71*a* calculates the critical maximum tension $T_{wik}$ explained in Formula (6) on the basis of the physical properties of the web 10 and driving information memorized in the memory 70. The critical tension $T_{wik}$ is outputted to the tension control means 72.

The critical minimum tension calculating means 71*b* calculates the minimum tension on the web 10, in which the slip is occurred in the web 10. The means 71*b* calculates the critical minimum tension $T_{slip}$ explained in Formula (16) on the basis of the physical properties of the web 10 and driving information memorized in the memory 70. The critical minimum tension $T_{slip}$ is outputted to the tension control means 72.

The tension control means 72 controls the tension on the web 10. The means 72 adjusts the position of the shaft 20*b* of the dancer roller 2*b* to control the tension on the web 10. The means 72 includes initial tension setting means 72*a*, measured tension input means 72*b* and tension range control means 72*c*.

The initial tension setting means 72*a* sets the initial tension on the web 10. The means 72*a* sets the initial tension as the tension $T_0$ determined by following Formula (17), on the basis of the critical tensions $T_{wik}$ and $T_{slip}$ calculated by the critical tension calculating means 71. For example, the tension $T_0$ is set as the average value of the critical maximum tension $T_{wik}$ and critical minimum tension $T_{slip}$.

$$T_{slip}<T_0<T_{wik} \tag{17}$$

The measured tension input means 72*b* inputs the tension measured by the tension sensor 40 of the tension adjusting means 4 as the measurement value. The measurement value inputted from the means 72*b* is transmitted to the tension range control means 72*c*.

The tension range control means 72*c* controls the dancer roller 2*c* such that the tension on the web 10 is within the range between the critical tensions $T_{wik}$ and $T_{slip}$.

The means 72*c* outputs the drive signal (for tension control) to the tension adjusting means 4 so that the initial tension set by the initial tension setting means 72*a* is the tension on the web 10. Moreover, the means 72*c* outputs the drive signal (for tension control) to the tension adjusting means 4 so that the tension range inputted from the measured tension input means 72*b* is in the range between the critical tensions $T_{wik}$ and $T_{slip}$.

The image analyzing means 73 detects the waveform generated on the web 10 on the basis of the color or brightness of the image picked up by the camera 3 and analyzes the direction of the linear pattern as the entering direction of the waveform into the guide roller 2*c* using the predetermined coordinate system. The means 73 includes image input means 73*a* and waveform detecting means 73*b*.

The image input means 73*a* inputs the image picked up by the camera 3. The means 73*a* inputs the image picked up by the camera 3 in frame unit in time series and outputs to the waveform detecting means 73*b*.

The waveform detecting means 73*b* analyzes the image inputted from the image input means 73*a* to detect the waveform as the sign of wrinkling of the web 10 and the entering direction of the waveform into the guide roller 2*c*.

Figure 6:
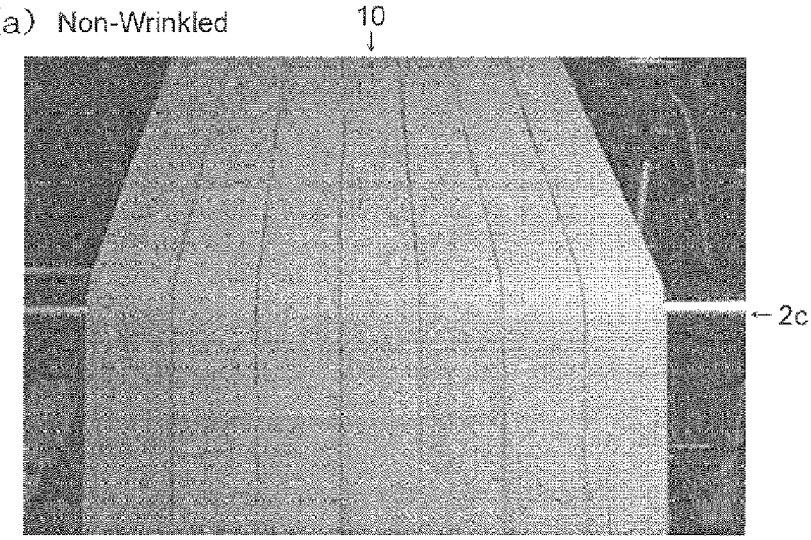
FIG. 6 shows the situation that the wrinkle is generated on the web passing through a guide roller, (a) depicts the non-wrinkle situation, (b) depicts the situation where a waveform as the sign of wrinkles occurs, and (c) depicts the situation where the wrinkle is generated.
Figure 6:
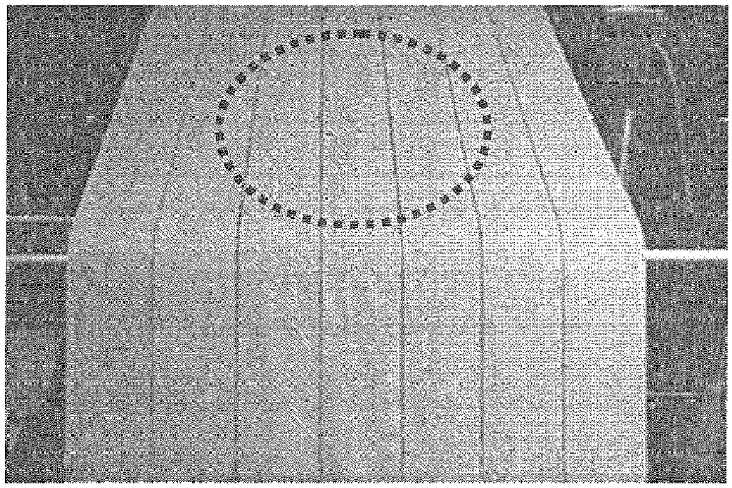
Figure 6:
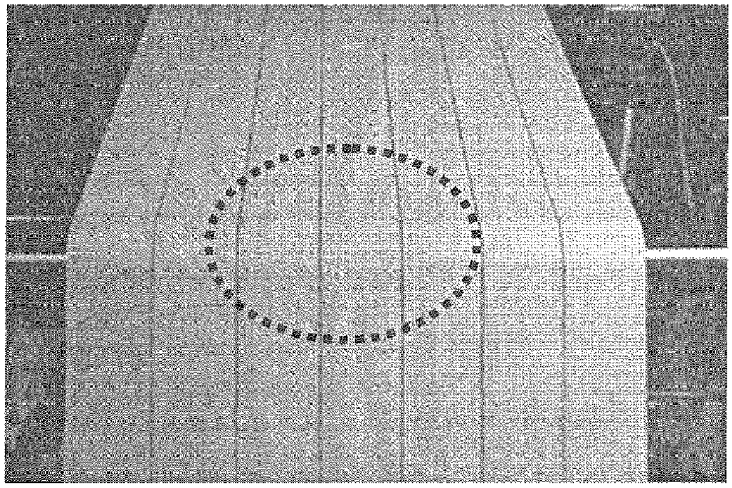

Referring to FIG. 6, the wrinkle generated in the web 10 and the waveform as the sign thereof are explained. FIG. 6 shows the situation that the wrinkle is generated on the web passing through the guide roller, (a) depicts the non-wrinkle situation, (b) depicts the situation where the waveform as the sign of wrinkles occurs, and (c) depicts the situation where the wrinkle is generated. The web 10 shown in FIG. 6 is depicted with checkered pattern to easily find the wrinkle.

Before the wrinkle is generated as shown in FIG. 6(*c*), the waveform occurs on the web 10 (waving) as shown in FIG. 6(*b*). The waveform grows into the wrinkle.

While, when the waveform (waving) occurs as shown in FIG. 6(*b*), to adjust the shaft angle of the guide roller 2*c* makes the waveform dampen or disappear. That is because the waveform shown in FIG. 6(*b*) can return due to the elasticity of the web 10.

Referring to FIG. 5 again, the explanation of the structure of the controller 7 is continued.

As explained in FIG. 6, when the wrinkle is generated, the waveform appears on the web 10 as the sign. The waveform detecting means 73*b* analyzes the image picked up by the camera 3 to detect the waveform shown in FIG. 6(*b*).

For example, the means 73*b* uses Hough transform to detect the linear pattern (linear pattern of the waveform as the sign of wrinkling) in the image and find the direction of the linear pattern (entering direction of the waveform).

When the image is a color image, the waveform appeared on the web 10 is detected as the linear pattern by detecting the pixel value belonged to the predetermined color vector. When the image is monochrome image, the waveform is detected as the linear pattern on the basis of the difference in brightness.

The means 73*b* uses Hough transform to transform the x-y coordinate system into ρ-θ coordinate system and find the inclination of the linear pattern.

The order that the means 73*b* detects the waveform and the entering direction of the waveform into the guide roller 2*c* are inputted to the shaft angle control means 74.

The shaft angle control means 74 controls the skew angle of the guide roller 2*c* on the basis of the entering direction of the waveform detected by the waveform detecting means 73*b*. The means 74 outputs the drive signal (for alignment control) to the alignment adjusting means 5 so that the shaft direction of the guide roller 2*c* is perpendicular to the entering direction of the waveform into the roller 2*c*.

Figure 7:
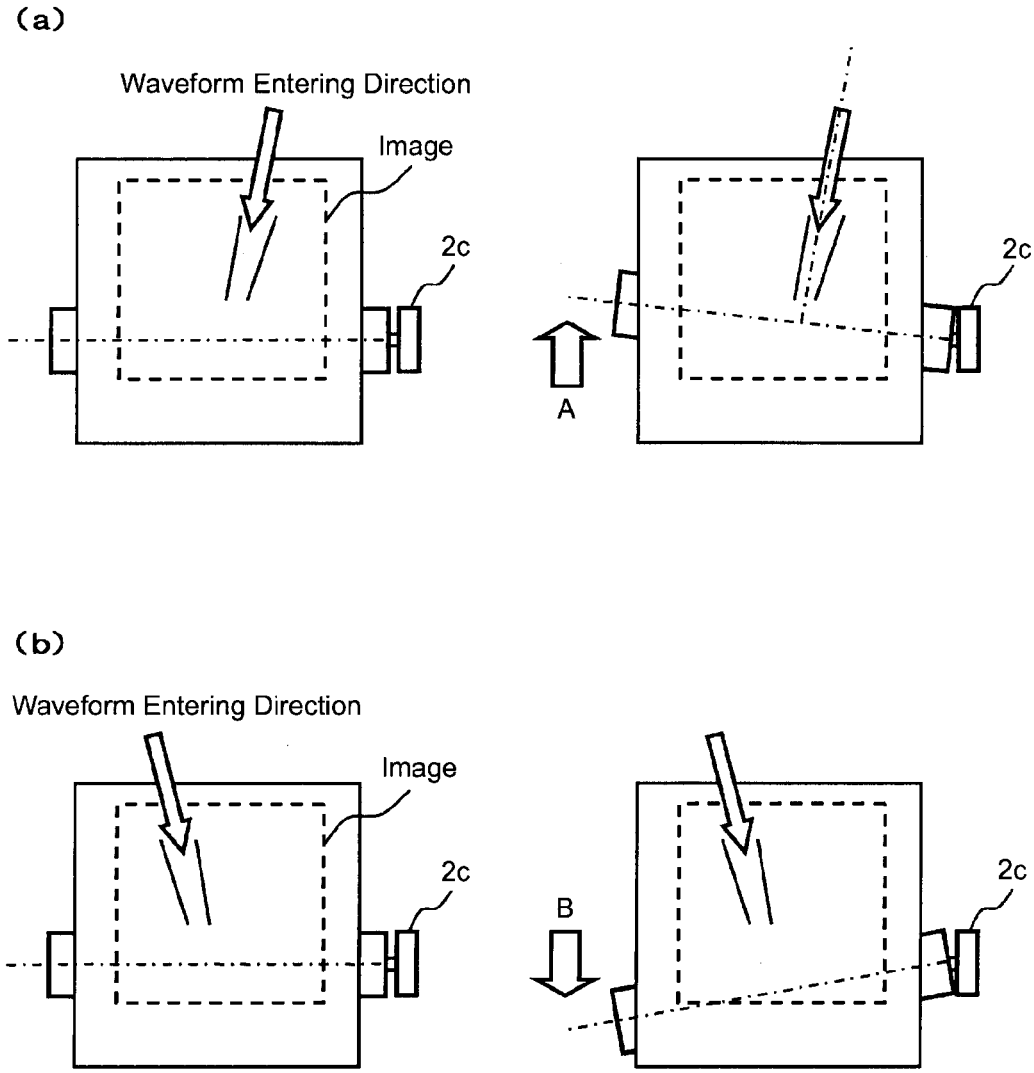
FIG. 7 shows a control method as to the guide roller when the waveform as the sign of wrinkles (waving) appears on the web.

Referring to FIG. 7, the adjustment direction to the skew angle of the guide roller 2*c* is explained. FIG. 7 shows the control method as to the guide roller when the waveform as the sign of wrinkles (waving) appears on the web. In the figure, the images picked up by the camera 3 are shown and the web 10 is transported around the guide roller 2*c* from the upper side to lower side in the figure.

FIG. 7(*a*) depicts the situation that the waveform enters from the right upper side to the left lower side in the figure. The shaft angle control means 74 adjusts the skew angle to the arrow A direction in which the guide roller 2*c* is perpendicular to the entering direction of the waveform.

FIG. 7(*b*) depicts the situation that the waveform enters from the left upper side to the right lower side in the figure. The shaft angle control means 74 adjusts the skew angle to the arrow B direction in which the guide roller 2*c* is perpendicular to the entering direction of the waveform.

Note that in FIG. 7, for facilitating the understanding, the skew angle of the guide roller 2*c* is adjusted by the large angle, however the skew angle is gradually adjusted by 1 degree or 2 degrees.

Thus, the waving disappears, thereby preventing the wrinkle.

Referring to FIG. 5 again, the explanation of the structure of the controller 7 is continued.

The drive control means 75 outputs the drive signal (for power supply) for ordering the roller driving means 6 for transportation of the web 10 at the predetermined velocity so that the driving roller 2*d* is driven. The means 75 outputs the drive signal (for power supply) on the basis of the web transporting velocity memorized in the memory 70.

The controller 7 may be operated by means of a web transport control program which orders the computer to perform the functions as the above-described means.

Figure 8:
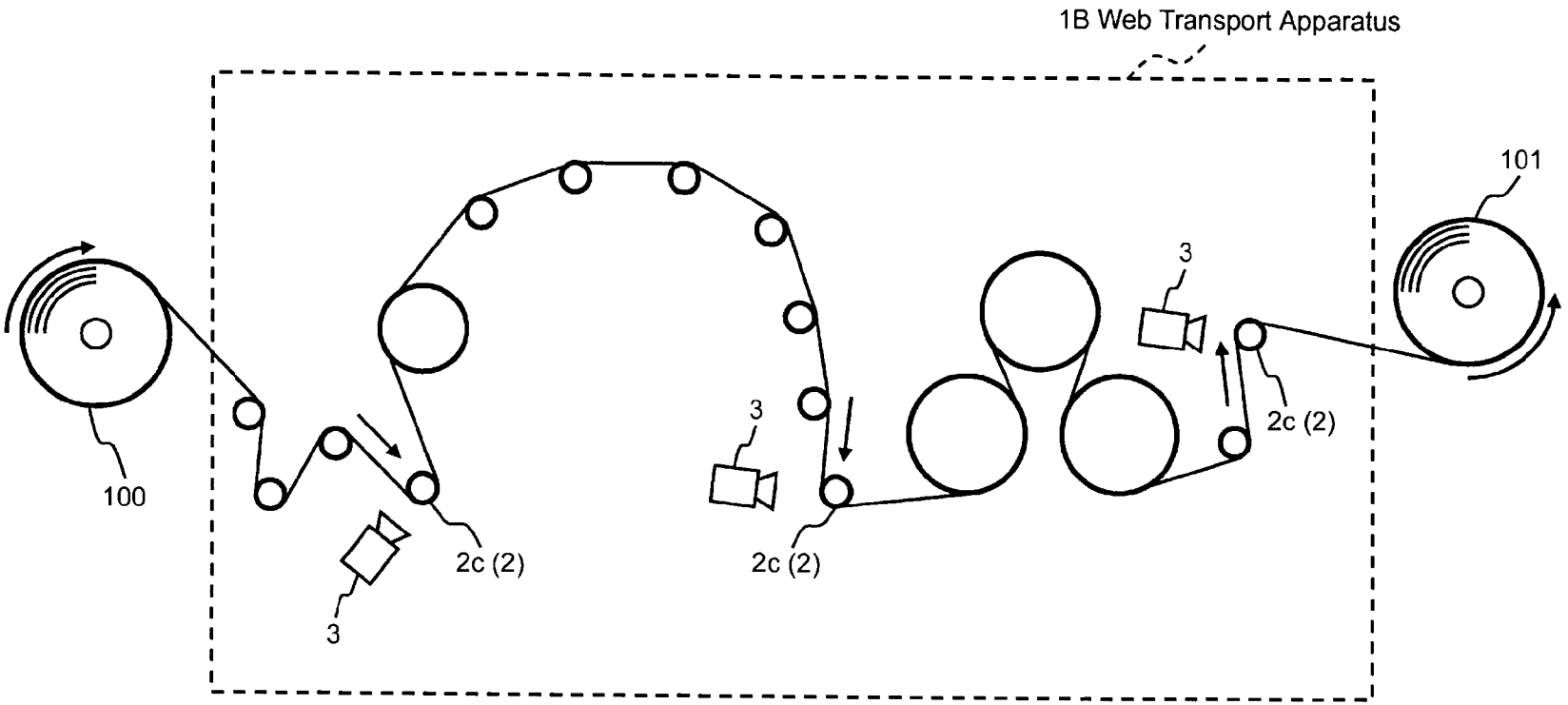
FIG. 8 depicts a side view of the other web transport apparatus according to the present invention.

The structure of the web transport apparatus 1 is explained above, although the structure in accordance with the present invention is not limited to the structure. In the present invention, the guide roller 2*c* adjusts the misalignment angle with respect to the adjacent upstream roller 2*b*, so that the wrinkles are prevented from generating in the web 10. As shown in FIG. 8, a web transport apparatus 1B, for example, includes more number of rollers than the apparatus 1 (see FIG. 3), provided with the multiple guide rollers 2*c* and cameras 3, in which each guide roller 2*c* adjusts the misalignment angle with respect to the adjacent upstream roller.

[Operation of Web Transport Apparatus]

Figure 9:
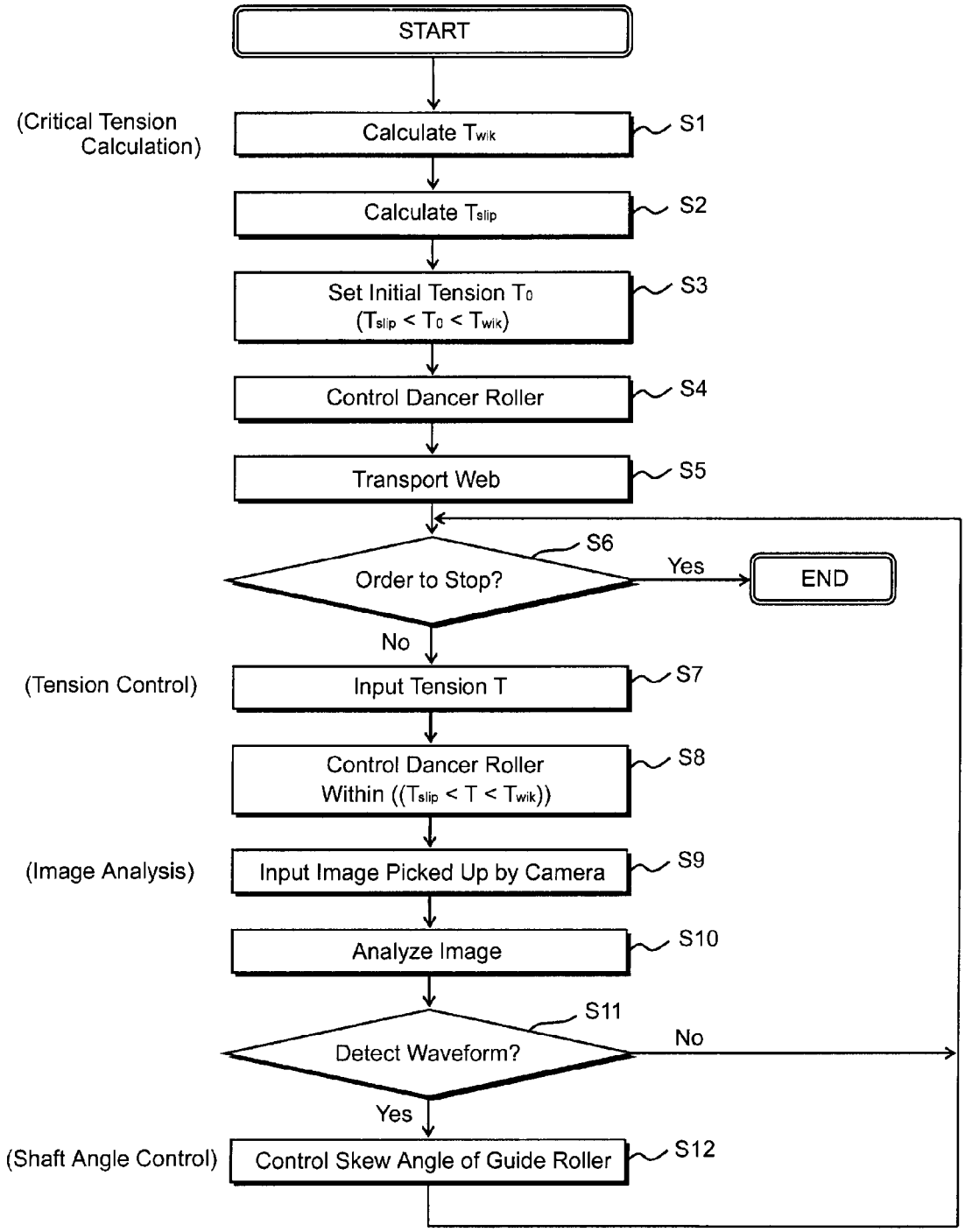
FIG. 9 is a flowchart of an operation of the web transport apparatus according to the present invention.

Referring to FIG. 9 (and FIGS. 3, 4, 5), the operation of the web transport apparatus 1 is explained. FIG. 9 is a flowchart of the operation of the web transport apparatus in accordance with the present invention. In the explanation, the operation of the apparatus 1 is explained with priority given to the controller 7.

(Critical Tension Calculation Step)

The apparatus 1 calculates the maximum tension (critical maximum tension $T_{wik}$) on the web 10 in which the wrinkle is generated in the web 10 by means of the critical maximum tension calculating means 71*a* of the critical tension calculating means 71 (Step S1). The apparatus 1 calculates the minimum tension (critical minimum tension $T_{slip}$) on the web 10 in which the slip occurs in the web 10 by means of the critical minimum tension calculating means 71*b* of the critical tension calculating means 71 (Step S2).

The apparatus 1 sets the initial tension (tension $T_0$) within the range between the critical tensions $T_{wik}$ and $T_{slip}$ by means of the initial tension setting means 72*a* of the tension control means 72 (Step S3).

The apparatus 1 controls the dancer roller 2*b* such that the tension on the web 10 is the tension set in the step S3 by means of the tension range control means 72*c* of the tension control means 72 (Step S4).

Due to the above operation, the apparatus 1 initializes the tension.

The apparatus 1 outputs the drive signal from the drive control means 75 to the roller driving means 6 to rotate the driving roller 2*d* for transportation of the web 10 (Step S5). The apparatus 1 carries out the following steps: a tension control step, an image analysis step and shaft angle control step.

Here, when received the order to stop the operation ("Yes" in Step S6), the apparatus 1 stops. On the other hand, when there is no order to stop the operation ("No" in Step S6), the operation proceeds to Step S7.

(Tension Control Step)

The apparatus 1 inputs the tension T on the web 10 measured by the tension sensor 40 of the tension adjusting means 4 by means of the measured tension input means 72*b* of the tension control means 72 (Step S7).

The apparatus 1 outputs the drive signal to the tension adjusting means 4 such that the tension T on the web 10 is in the range between the critical maximum tension $T_{wik}$ calculated in the Step S1 and the critical minimum tension $T_{slip}$ calculated in the Step S2, and controls the vertical position of the dancer roller 2*b* (Step S8).

Due to the above operation, the web 10 is transported in the stable area $S_T$ that is the range between the critical tensions $T_{wik}$ and $T_{slip}$ as depicted in FIG. 2; therefore the wrinkles and slips in the web 10 are prevented from generating.

Note that, according to the physical properties of the web 10, there is the case where the range between the critical tensions $T_{wik}$ and $T_{slip}$ is narrow, in which it is difficult to control the tension within the range between the critical tensions $T_{wik}$ and $T_{slip}$.

So, the apparatus 1 controls the misalignment angle (skew angle) of the guide roller 2*c* to prevent wrinkles.

(Image Analysis Step)

The apparatus 1 inputs the image of the web 10 transported on the guide roller 2*c* picked up by the camera 3 in a frame unit in time series by means of the image input means 73*a* of the image analyzing means 73 (Step S9).

The apparatus 1 analyzes the image inputted in the Step S9 to detect the waveform as the sign of wrinkles (waving) and the entering direction of the linear pattern of the waveform into the guide roller 2*c* by means of the waveform detecting means 73*b* (Step 10).

The apparatus 1 determines whether the linear pattern of the waveform is detected by the means 73*b* or not (Step S11).

(Shaft Angle Control Step)

When the linear pattern of the waveform is detected in the Step S11 ("Yes"), the apparatus 1 inputs the drive signal to the alignment adjusting means 5 to pivot the shaft 20*c* such that the entering direction of the waveform (linear pattern) detected in the Step S10 is perpendicular to the shaft 20*c* of the guide roller 2*c* by means of the shaft angle control means 74 for control of the skew angle of the guide roller 2*c* (Step S12).

Thus, if the operating condition is in the wrinkle area $W_r$, the skew angle of the guide roller 2*c* is controlled, so that the condition returns to the stable area $S_T$, and the generation of wrinkles is prevented.

After the Step S12 or when there is no detection of the waveform in the Step S11 ("No"), the apparatus 1 returns to the Step S6 and continues the operation.

Due to the above operation, the apparatus 1 transports the web 10 without wrinkling and slipping.

Note that, in the embodiment, the tension control step is followed by the image analysis step and shaft angle control step, although the order of these operations may be reversed. Moreover, these operations may be performed parallelly. In the critical tension calculation step, the Step S1 and Step S2 may be reversed or performed parallelly.

Industrial Applicability

The web transport apparatus, web transporting method and web transport control program according to the present invention are applicable to the technique of transporting the sheet web supported by the multiple rollers.

The invention claimed is:

1. A web transport apparatus transporting a sheet web by using multiple rollers, comprising:

a driving roller transporting the web;

an angle adjustable roller disposed adjacent upstream of the driving roller in a transportation direction, provided with a shaft adjustable in a shaft direction;

imaging means for picking up an image of the web transported on the angle adjustable roller;

alignment adjusting means for adjusting the angle of the shaft of the angle adjustable roller; and a controller, wherein the controller comprising:

image analyzing means for finding a linear pattern of a waveform as a sign of wrinkling generated on the web from the image picked up by the imaging means, and for analyzing an entering direction of the linear pattern into the angle adjustable roller; and shaft angle control means for controlling the alignment adjusting mean on the basis of the entering direction of the linear pattern into the angle adjustable roller, whereby the web is not wrinkled.

2. A web transport apparatus transporting a sheet web by using multiple rollers, comprising:

a driving roller transporting the web;

an angle adjustable roller disposed adjacent upstream of the driving roller in a transportation direction, provided with a shaft adjustable in a shaft direction;

imaging means for picking up an image of the web transported on the angle adjustable roller;

alignment adjusting means for adjusting the angle of the shaft of the angle adjustable roller; and a controller, wherein the controller comprising:

image analyzing means for detecting a linear pattern of a waveform generated on the web to find a sign of wrinkling in the web from the image picked up by the imaging means, and for analyzing an entering direction of the linear pattern into the angle adjustable roller; and shaft angle control means for adjusting the shaft of the angle adjustable roller such that the shaft direction is perpendicular to the entering direction of the linear pattern analyzed by means of the image analyzing means, and for controlling the alignment adjusting means, whereby the web is not wrinkled.

3. The web transport apparatus according to claim 2, wherein the image analyzing means detects the linear pattern of the waveform in the image on the basis of a color or brightness of the image, and determines the direction of the linear pattern as the entering direction on the basis of a predetermined coordinate system.

4. The web transport apparatus according to claim 2, further comprising:

a dancer roller arranged as one of the rollers, applying a tension to the web;

tension measuring means for measuring the tension applied by the dancer roller; and tension adjusting means for moving the dancer roller to adjust the tension on the web, wherein the controller further comprising:

critical tension calculating means for calculating a critical minimum tension on the web in which the web slips and a critical maximum tension on the web in which the web is wrinkled, on the basis of a driving information as to a predetermined driving condition and of a physical property of the web; and tension control means for controlling the tension adjusting means such that the tension measured by the tension measuring means is within the critical minimum tension and the critical maximum tension.

5. A web transporting method for a web transport apparatus provided with multiple rollers transporting a sheet web, the method comprising:

a critical tension calculation step of calculating a critical minimum tension on the web in which the web slips and a critical maximum tension on the web in which the web is wrinkled, on the basis of a driving information as to a predetermined driving condition of the web transport apparatus and of a physical property of the web;

a tension control step of controlling the tension on the web such that the tension is within the critical minimum tension and the critical maximum tension;

an image analysis step of detecting a linear pattern of a waveform generated on the web from an image picked up in the web being transported on an angle adjustable roller that is adjustable in a shaft direction and analyzing an entering direction of the linear pattern into the shaft of the angle adjustable roller;

a shaft angle control step of moving the shaft of the angle adjustable roller such that the shaft direction is perpendicular to the entering direction of the linear pattern analyzed in the image analysis step.

6. A web transport control program for a web transport apparatus provided with multiple rollers transporting a sheet web, the program ordering a computer to perform functions of:

calculating a critical minimum tension on the web in which the web slips and a critical maximum tension on the web in which the web is wrinkled, on the basis of a driving information as to a predetermined driving condition of the web transport apparatus and of a physical property of the web;

controlling the tension on the web such that the tension is within the critical minimum tension and the critical maximum tension;

detecting a linear pattern of a waveform generated on the web from an image picked up in the web being transported on an angle adjustable roller that is adjustable in a shaft direction and analyzing an entering direction of the linear pattern into the shaft of the angle adjustable roller; and moving the shaft of the angle adjustable roller such that the shaft direction is perpendicular to the entering direction of the analyzed linear pattern.

* * * * *